United States Patent [19]

Belleli

[11] 4,318,441

[45] Mar. 9, 1982

[54] COUNTERFLOW HEAT EXCHANGER

[75] Inventor: Riccardo Belleli, Mantova, Italy

[73] Assignee: Belleli Industrie Meccaniche S.p.A., Mantova, Italy

[21] Appl. No.: 39,005

[22] Filed: May 14, 1979

[30] Foreign Application Priority Data

May 19, 1978 [IT] Italy ..... 23619 A/78
May 19, 1978 [IT] Italy ..... 23620 A/78

[51] Int. Cl.[3] ..... F28F 9/02
[52] U.S. Cl. ..... 165/81; 165/163
[58] Field of Search ..... 165/81, 158–163; 122/32, 34

[56] References Cited

U.S. PATENT DOCUMENTS 3,732,922 5/1973 Pouderoux ..... 165/163 X
3,854,528 12/1974 Pouderoux et al. ..... 165/158
4,117,885 10/1978 Nickerson et al. ..... 165/163 X
4,120,348 10/1978 Pouderoux ..... 165/81
4,187,902 2/1980 Miller, Jr. et al. ..... 165/158 X

FOREIGN PATENT DOCUMENTS 1097551 7/1955 France ..... 165/158
653496 3/1979 U.S.S.R. ..... 165/163

*Primary Examiner*—Sheldon J. Richter
*Attorney, Agent, or Firm*—Guido Modiano; Albert Josif

[57] ABSTRACT

A counterflow heat exchanger comprises coaxial upper and lower tube plates wherebetween extends a tube nest including a plurality of tubes laid parallel to the exchanger axis. The tubes are distributed in a substantially polar symmetry arrangement and have the terminating portion of at least one end thereof substantially perpendicular to the exchanger axis, while the rectilinear portion of the tube nest, which constitutes the heat exchange zone, is enclosed within an annular interspace defined between an inner jacket and an outer shroud.

26 Claims, 18 Drawing Figures

COUNTERFLOW HEAT EXCHANGER

BACKGROUND OF THE INVENTION

This invention relates to a counterflow heat exchanger having two fixed tube plates and a thermal exchange zone comprising substantially straight tubes, and in particular to a heat exchanger suitable for high pressure and temperature service, to be employed in either conventional or nuclear power stations, as well as in other industrial plants.

As is known, several industrial plates make use of counterflow heat exchangers which are of considerable size, and owing to the severe operating conditions encountered, expected to provide the highest and most comprehensive degree of reliability, both to avoid halting the plants, with obviously heavy consequences of an economical nature, and for inherent safety reasons. Typical examples are the steam generators using sodium as the primary fluid, which are installed at nuclear power stations of the LMFBR type.

Heretofore, such heat heat exchangers used to comprise, in the majority of cases, a pair of oppositely located tube plates, arranged to face each other at a distance apart, which are interconnected by a nest of tubes welded to the plates themselves in a manner that will be explained hereinafter, for the passage of the secondary fluid; also provided is a shroud or outer casing which connects the tube plates to each other such as to enclose the tube nest and confine the primary fluid passage zone.

The structure of such heat exchangers, as well as that of other known designs, has first of all the serious disadvantage—which affects in particular the cited steam generators using sodium as the primary fluid—of a disuniform primary fluid flow at the thermal exchange zone, which flow, at the usually circular center portion of the stream section, has a higher velocity than at the periphery thereof; this results in a non-uniform distribution of the wall temperature in the various tubes, with attendant negative consequences, particularly of mechanical and structural nature, as the expert will readily recognize.

Moreover, the inlet and outlet flows of the primary fluid are not perfectly uniform, as dictated by the provision of conventional annular headers, usually arranged externally to the tube nest.

Furthermore, it is known that in high reliability heat exchangers, the best procedure currently adopted for welding the tubes to the tube plates is one selected from the IBW (Internal Bore Welding) techniques and enables the tubes to be butt welded to spigot members, purposely formed on the plates and bored to a diameter which is substantially equal to the inside diameter of the tube; more specifically, this type of weldment, which is known per se, provides for the end of the tube to be welded to fit inside a seat formed on the spigot, as prearranged on the tube plate, thereafter access is gained with a welding torch to the tube inside, at the joint area, to carry out the welding, usually without deposition of any weld material.

This type of weldment, especially in view of the severe operating conditions anticipated for the cited exchanger designs, must then be individually checked, in general by X-ray or ultrasonic inspection, to ascertain its reliability.

Now, as mentioned, in most heat exchangers of conventional design, the tube plates are arranged to face each other from a distance apart, thereby in order to allow the individual tubes which make up the nest to be installed in conformity with accepted manufacturing and inspection practices, it becomes necessary to provide one plate with bores having substantially the same size as the tube outside diameter, whereas the other plate can be prefabricated with spigots having seats adapted for convenient application to the aforementioned welding procedure.

A serious problem encountered with conventional heat exchangers of this type is that the requirement of providing one plate with bores having the same size as or a size slightly larger than the tube outside diameter makes it necessary to insert the tube end for a few millimeters inside the bore, purposely made oversize to accommodate the tube, thereby, when this tube end is welded to the tube plate, the weldment area acquires a substantially truncated cone flare-out rather than being rectilinear.

The presence of this flare-out at the weldment area has first of all the disadvantage of being liable to undergo deflection and shear actions, which are technically undesirable in this type of joint, and moreover this type of weldment is difficult to X-ray, such that considerable problems are encountered during the insepection step; troubles may also arise from the fluid dynamics characteristics which result therefrom.

A further serious drawback of the heat exchangers of the type just described, as well as of other conventional such designs, resides in that for obvious reasons of construction and inspection at least part of the outer casing or shroud must be attached to the tube plates after welding the tube nest to the plates, thereby considerable difficulty is experienced when it comes to X-raying the shroud weldments, while it is impossible to reweld the weldments because no access can be had to the inside. It should be further added to the foregoing that when the shroud is connected to the tube plates after the installation of the tube nest, any heat treatment of the welded areas of the shroud becomes extremely difficult to carry out.

Provision may be made in the heat exchangers of the type described above for the presence of an expansion joint in the shroud effective to accommodate thermal expansion differentials between the tube nest and shroud; while in the latter case there still exists the possibility of the whole tube nest expanding, any expansion differentials, as originating from various causes, between the tubes are nevertheless prevented, an example of such causes being a different flow distribution from one tube to another. These expansion differentials unavoidably generate stresses that concentrate at the weldment areas of the tubes to the tube plates, which brings about obvious risks and trouble especially with joints of conventional type, where as mentioned deflection and shear stresses are induced.

Still another drawback of almost all the known types, and one which is more markedly evident when high pressures are involved, is that the forged stock used for forming the tube plates has a large mass, which adds complications of mechanical, thermal, and metallurgical nature. Also considerable is the difficulty of assembling the tube nest.

SUMMARY OF THE INVENTION

Thus, the instant invention sets out to provide a counterflow heat exchanger having two fixed tube plates and a thermal exchange zone comprising substantially straight tubes, which is so constructed as to allow the application of the IBW techniques to the butt welding of the ends of the tube nest onto spigots formed on both tube plates and having a bore with substantially the same diameter as the tube inside diameter.

Within that general aim, it is possible to arrange that the heat exchanger according to the invention, while having both its tube plates fixed, allows for a different expansion rate of the tubes in the tube nest, and above all for that expansion differential among the tubes to occur without inducing deflection and shear stresses in either weldments of each tube to the tube plates.

It is further possible to arrange for the provision of weldment areas between the tubes and plates, as well as between the shroud and plates, which can be readily inspected and that, as relates to the tube-to-plate weldments, ultrasonic inspection be also facilitated, thus ensuring the highest degree of reliability in such joints.

Moreover, it is further possible, according to this invention, that a heat exchanger be provided wherein the tubes wherethrough the secondary fluid is circulated are arranged in polar symmetry, namely a symmetry situation which remains substantially the same in all the planes making up the star about the longitudinal axis of the exchanger, or in other words, uniformly distributed in an annulus, such that said tubes are uniformly enveloped in the stream of primary fluid. A first advantage of the tube arrangement described above is that the circulation of the primary fluid through a duct having an annulus cross-sectional shape occurs with a better distribution than is obtainable with conventional heat exchangers, wherein the stream section of said fluid occupies the entire circular cross-section of the exchanger, with attendant lack of uniformity between the central portion and the portions proximate to the walls; a polar symmetry distribution is also achieved for the thermal gradients in the exchanger structure, thus achieving a condition of substantial indentity in the distribution of temperatures in each axial section, which brings about obvious and important advantages as relates to the distribution of the mechanical stresses resulting in said structure.

It is further possible to arrange for the provision, in this invention, of an optimal flow uniformity for the primary fluid at the tube nest inlet and outlet ends, by using a simpler structure than the current one which comprises annular headers, usually located on the outside of the tube nest.

It is further possible to arrange that this invention provides a structure wherein all of the weldment areas of the tubes to the tube plates are only subjected to substantially tensile or compressive stresses, with the resultant advantage that no deflection and shear stresses are induced therein which are technically objectionable. Moreover, probes can be easily inserted for periodically checking the tube-to-plate weldments, without prior disassembly of the apparatus, which operation would evidently be a tedious and time-consuming one, and accordingly very expensive.

It is further possible, in this invention, to arrange for the utilization, in forming the tube plates, of reduced mass forgings, as this brings about several advantages, the first whereof is the capability of achieving good mechanical properties in the material, which would instead be difficult to accomplish with large mass forgings, as is the case with most conventional designs; of particular usefulness is then the adoption of small mass and thickness forgings when the operating conditions involve high thermal gradients between the primary and secondary fluids, specially fast thermal transients, and the primary fluid has high thermal conductivity, which conditions may all be encountered in steam generators using sodium as the primary fluid.

According to one aspect of the present invention, there is provided a counterflow heat exchanger having two fixed tube plates, characterized in that it comprises an upper tube plate and a lower tube plate, said tube plates being coaxial with each other, between said upper and lower tube plates there extending a tube nest including a plurality of tubes laid parallel to the exchanger axis, said tubes of said plurality being connected to said tube plates and substantially distributed in a polar symmetry arrangement and having the terminating portion of at least one end substantially perpendicular to the exchanger axis, the rectlinear portion of said tube nest, substantially constituting the heat exchange zone, being enclosed with substantially uniform distribution within an annular interspace defined between an inner jacket and an outer shroud affixed to said tube plates.

BRIEF DESCRIPTION OF THE DRAWINGS

Further features and advantages will become more clearly apparent from the description of five preferred, though not exclusive, embodiments of a counterflow heat exchanger having two fixed tube plates, such as may be employed for instance as a steam generator in nuclear power stations which utilize liquid sodium for a primary fluid, illustrated by way of example only in the accompanying drawings, where.

DESCRIPTION OF THE PREFERRED EMBODIMENTS

Figure 1:
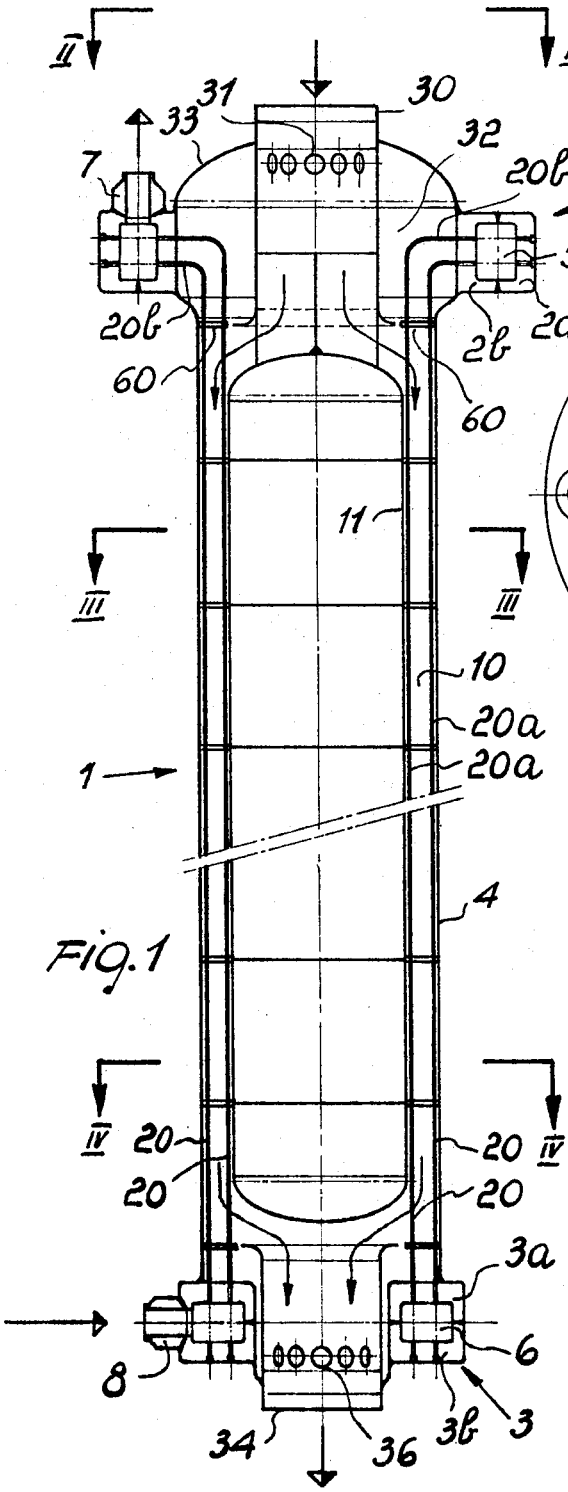
FIG. 1 is a schematical longitudinal section view of the heat exchanger according to a first embodiment of this invention.
Figure 2:
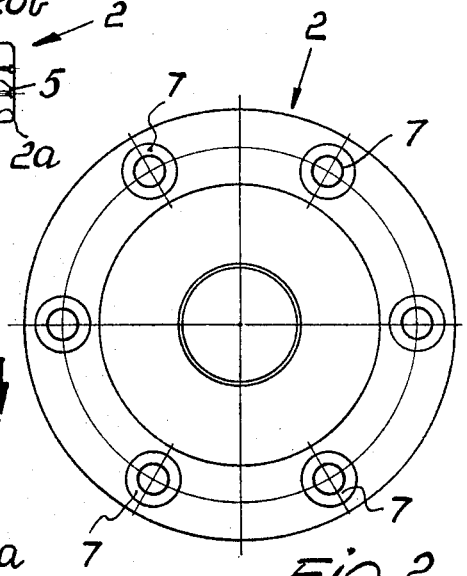
FIG. 2 is a sectional view taken along the line II—II of FIG. 1.
Figure 3:
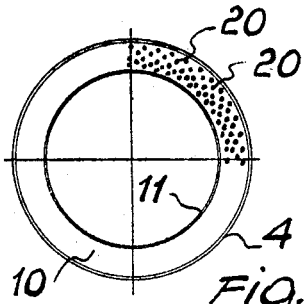
FIG. 3 is a schematical sectional view taken along the line III—III of FIG. 1.
Figure 4:
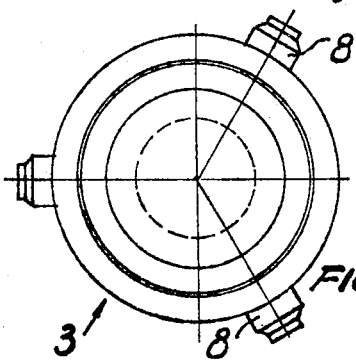
FIG. 4 is a sectional view taken along the line IV—IV of FIG. 1.
Figure 5:
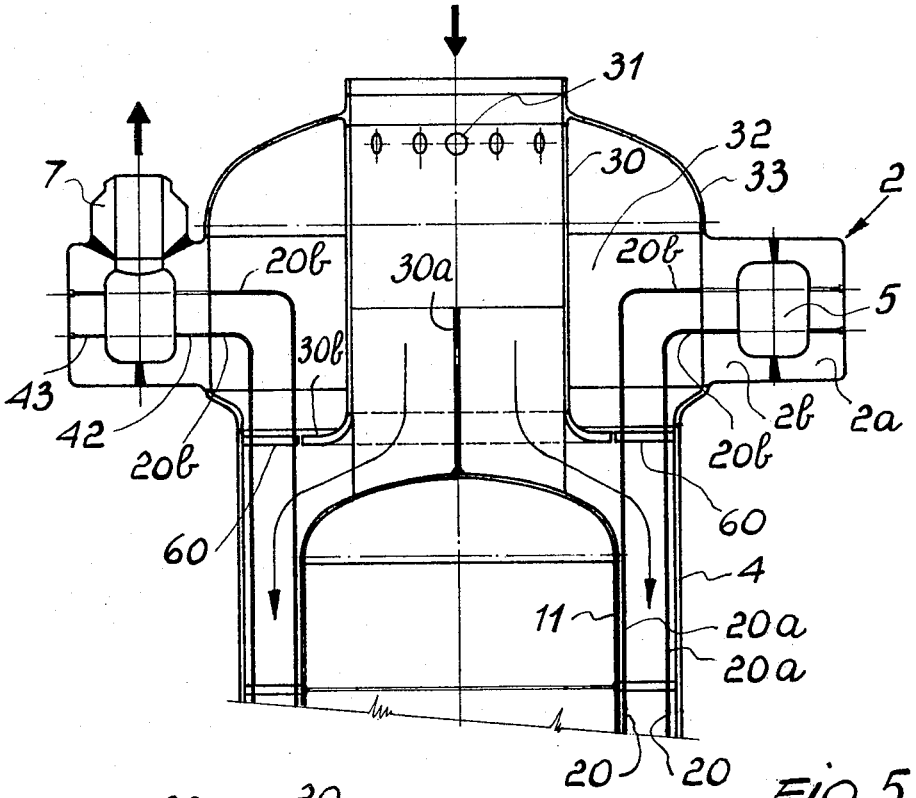
FIG. 5 is a schematical, enlarged scale, detail view of the upper tube plate of the embodiment shown in FIG. 1.
Figure 6:
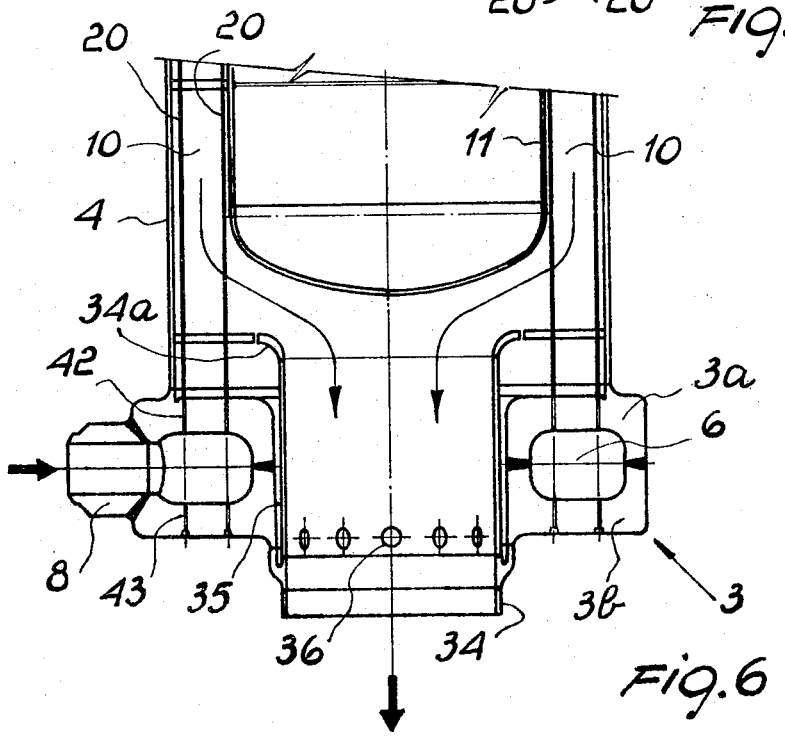
FIG. 6 is a schematical, enlarged scale, detail view of the lower tube plate of the embodiment shown in FIG. 1.
Figure 8:
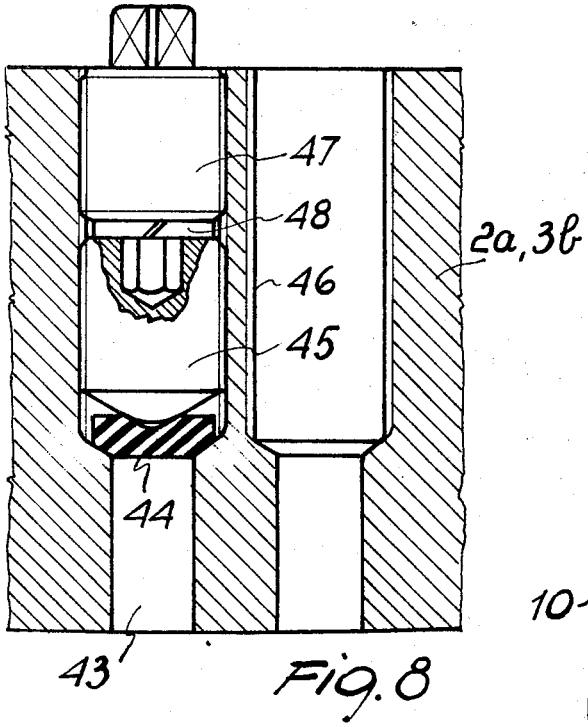
FIG. 8 is a sectional view of the locking or safety plugs arranged in holes provided through the tube plates, at the tubes, for all of the invention embodiments.
Figure 7:
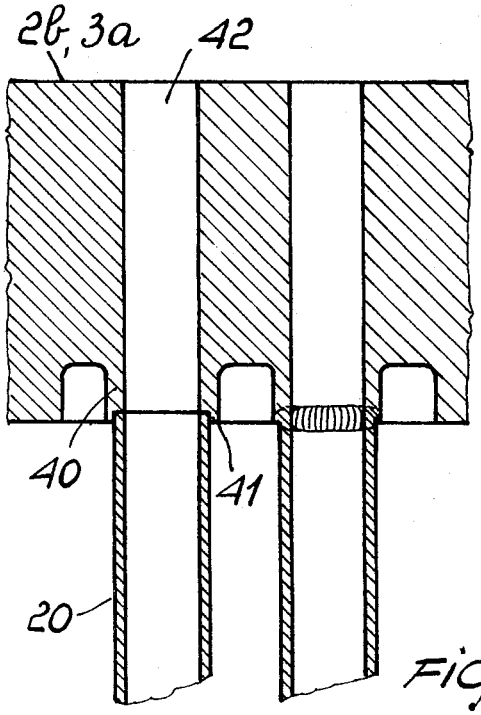
FIG. 7 shows schematically and in section the weldment areas or zones of the tubes in the tube nest to the tube plates, for all of the invention embodiments.

With reference to FIGS. 1 to 9 of the drawings, the counterflow heat exchanger 1 having two fixed tube plates, according to a first embodiment of this invention, will be presently described, which comprises an upper tube plate, generally indicated at 2, and a lower tube plate, generally indicated at 3. Said tube plates, 2 and 3, are of annular configuration and are arranged concentrically at a distance apart; moreover, the plate 3 has of preference a smaller diameter than the plate 2.

The plates 2 and 3 are connected together by an outer casing or shroud 4 of substantially cylindrical shape, which may include a thermal expansion joint, not shown, at a middle portion of its longitudinal extension. The shroud 4 is welded to the plates 2 and 3 prior to the introduction of the tube nest, such that it is possible to fully inspect the weldments made as weld as to reweld them reversely, to achieve certainty of a perfectly carried out construction.

More in detail, the plates 2 and 3 define respectively an upper annular chamber 5 and lower annular chamber 6 therein. The upper tube plate 2 is composed of an outer body 2*a* which is welded to an inner body 2*b*, thereby to define said chamber 5 which acts in practice as an outlet header of the secondary fluid and is provided with a plurality of radially arranged outlet fittings, indicated at 7, which are uniformly distributed with respect to the annular header upper tube plate 2.

The lower tube plate 3 is also formed by an upper or top body indicated at 3*a* and lower or bottom body, indicated at 3*b*, which are welded to each other such as to define said lower annular chamber which acts in practice as the secondary fluid inlet header and communicates with plural inlet fittings 8, also uniformly distributed.

The cited chambers, 5 and 6, are joined together by a tube nest which is accommodated within an annular interspace 10 defined between said outer casing or shroud 4 and an inner jacket 11, arranged coaxial with the shroud 4 and having a substantially cylindrical configuration closed at the top and bottom, said jacket being connected to the other parts of the heat exchanger structure at its top end only, such as to provide for free expansion.

The cited tube nest, and here lies a basic feature of this invention, comprises a plurality of uniformly distributed tubes, indicated at 20, which have a rectilinear portion 20*a* located within said interspace 10 and at one end, specifically the end on the side of the plate 2, a portion 20*b* which is bent outwardly in a substantially perpendicular direction to the axis of the exchanger and joined to the recilinear portion 20*a* by means of a quarter circle bend. The cited portions 20*b* may lay, for example, in a radial plane to the longitudinal axis of the exchanger, and connect with their free ends to the cylindrical surface which confines internally the upper tube plate 2, which plate is provided accordingly with a larger diameter than the lower plate 3.

Prior to discussing in detail the connections of the tubes 20 of the tube nest to the plates 2 and 3, it should be pointed out that from the jacket 11 there branches off upwardly, with the aid of ribs such as 30*a*, the primary fluid inlet duct 30, which penetrates the ring constituting the tube plate 2 such as to provide a thermal shield capable of protecting the plate itself against sudden temperature variations in the primary fluid; said duct 30 has at its lower or bottom end 30*b* a flare-out which creates, in cooperation with the top closure member of the jacket 11, a peripheral passageway for a uniform distribution of the primary fluid flow in the thermal exchange zone, as indicated by the arrows in the drawings, and is further provided with a plurality of openings 31 adapted to ensure a limited flow of primary fluid in the space portion 32 included between the tube plate 2, duct 30, and bottom cap 33 connected thereto.

The primary fluid outlet duct 34 is connected to the tube plate 3, and penetrates the ring defined thereby to form an interspace 35 which acts as a thermal shield, within which interspace a limited flow of primary fluid is determined by the openings 36; the upper or top end 34*a* of the duct 34 is flared to facilitate the flow of primary fluid as indicated by the arrows in the drawings, thus providing optimal conveyance conditions for the primary fluid to the outlet duct.

The tubes 20 are connected to the respective plates 2 and 3 by welding in conformity with the well known IBW (Internal Bore Welding) procedure of the TIG (Tungsten Inert Gas) type. A basic feature resides in that with the construction just described, the ends of the tubes 20 can be connected both to the upper plate 2 and lower plate 3 in a quite similar manner, since contrary to conventional designs, it is no longer necessary to provide for a larger diameter bore, namely a diameter dimension substantially equal to the tube outside diameter, but on both the upper and lower plates, spigots 40 can be provided which have an annular seat 41 wherein the ends of the tubes 20 are inserted.

More specifically, the cited spigots 40 are formed on the cylindrical surface of the body 2*b* and annulus surface of the body 3*a* of the respective plates 2 and 3. At each spigot 40, there is provided a hole 42, which communicates the tube 20 with the inside of the respective annular chamber, 5 or 6, which has an inside diameter which is substantially equal to the inside diameter of each tube 20.

Furthermore, at each hole 42 formed in the body 2*b* or 3*a*, there is provided through the body 2*a* or 3*b* a through hole 43 aligned with the hole 42 and effective to allow for the introduction of welding torches for welding the tube 20 to its respective spigot 40.

Each through hole 43 is removably closed by a seal member 44 which is compressed by a threaded pin 45 engaging a threaded portion 46 provided at the free end of the through hole 43, wherewith a locking or safety threaded pin 47 also engages with the interposition of a lockwasher 48.

This embodiment of the invention affords the faculty of removing the closures from the various through holes 43, thus permitting periodical inspection of the tubes and checking of the weldment areas.

It will be appreciated from the foregoing that a fundamental feature of the heat exchanger according to the invention resides in that, by providing substantially rectilinear tubes at the heat exchange zone which include a terminating portion substantially perpendicular to the exchanger axis, it becomes possible to execute in a quite similar manner and with the best possible procedure the connecting weldments to both the lower and upper plates, thus securing the advantage of having all the weldments uniformly completed and readily available for inspection with the X-ray method.

Another and no less important feature is that by having the tubes formed with a bent over terminating portion, any expansions that may take place in the tubes can be accommodated, and above all any expansion differentials, i.e. different expansion rates among the tubes as due to differences in the thermal distribution, can be freely discharged without such expansions creating stresses which may stress the weldment areas or zones.

Moreover, by using tubes which are all butt welded to the tube plates, the advantage is afforded that the welded areas are only stressed to a very limited extent, and substantially only tension or compression stressed, i.e. subjected to a type of stress which is more easily taken by the weldment and such as to induce no technically objectionable stresses.

It should be further added to the above that each tube 20 has its end welded to the body 3*a* of the tube plate 3 spaced apart from the point of communication between the annular chamber 6 and the hole 42, this being a provision of considerable import inasmuch as the fluid streamlines, in changing their direction while passing from the annular chamber 6 to the holes 42 leading to the tubes 20, obviously tend to create cavitation areas at their changes of direction, which areas, if allowed to occur at the weldments, would result in quick deterioration of the weldment areas. By contrast, in the exemplary embodiment just described, it can be seen that the weldment area of the free end of each tube 20 is spaced apart from the connection area between the holes 42 and annular chamber 6; this ensures that at the weldment areas the fluid streamlines are already channeled along their normal path, thus preventing undesired erosion of the weldment areas between the tubes and lower tube plate.

A further feature of the invention is that the cited bent over terminating portion 20*b* is arranged at the annular region 32 which, as mentioned, practically defines a portion of the primary fluid circuit wherein the fluid is virtually stagnant, thus inducing no vibratory condition in the portions 209*b* of the tubes 20.

It is further worth pointing out that feature of the invention which provides for low mass and thickness forgings in the construction of the tube plates, to achieve advantages that the expert will readily recognize.

The invention is also characterized by the fact that an axial lay has been provided for the inlet and outlet of the primary fluid, which solution makes for a simpler system layout, reduced costs, optimal fluid dynamics distribution of the fluid, and easy draining in case of failure.

Figure 9:
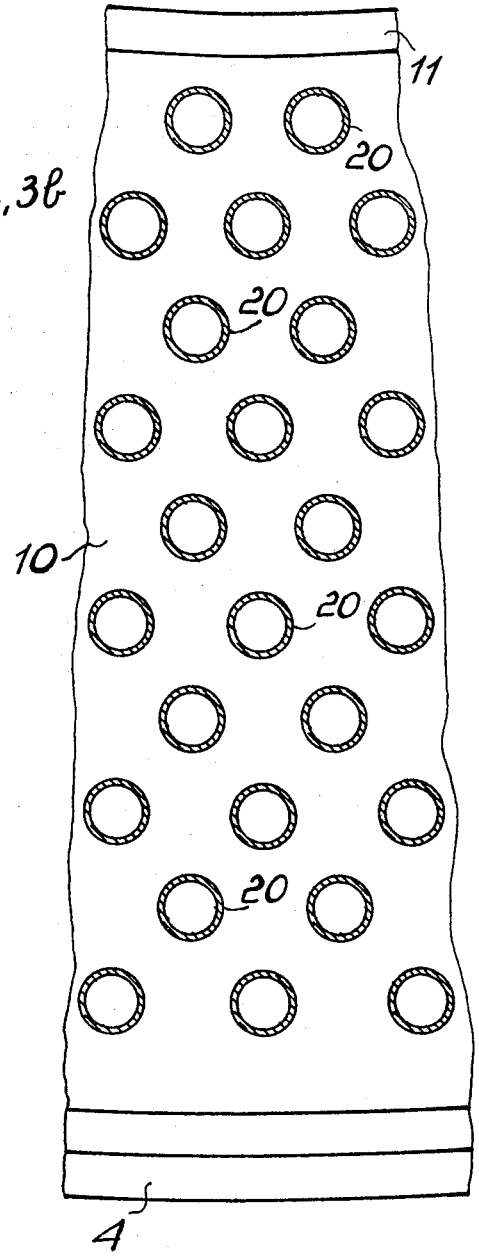
FIG. 9 is an enlarged scale cross-sectional view of a portion of the tube nest, for all of the invention embodiments.
Figure 11:
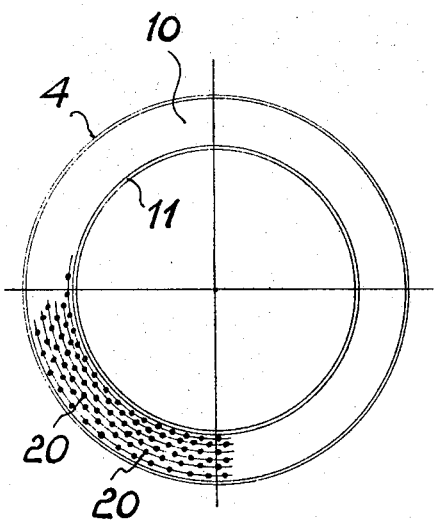
FIG. 11 is a schematical sectional view taken along the line XI—XI of FIG. 10.

Finally it should be noted that, for simplicity and clarity of illustration, the drawing figures show the outermost and innermost tubes of tube nest only, such tubes being those which locate all of the tubes 20; in fact, and as shown more clearly in FIG. 9, a plurality of tubes 20 are provided instead which are uniformly distributed in relation to one another and accommodated in the annular region 10.

The heat exchanger according to the invention is operated as follows. When the exchanger is utilized in the counterflow mode, the primary fluid, which has for example a temperature around 500° C. and a pressure of 10 metric atmospheres, is admitted through the inlet duct 30 into the heat exchanger such as to impinge on the tubes 20 in the tube nest located in the interspace 10; said primary fluid flows lengthwise along the interspace 10 to deliver heat to each tube 20, and is then led to the outlet duct 34. Simultaneously therewith, the secondary fluid, i.e. the fluid to be heated, is admitted into the lower annular chamber 6 through the inlet fittings 8 and conveyed to the tubes 20 to first flow, as mentioned, along the rectilinear portion 20*a*, where the thermal exchange takes place, and subsequently the portion 20*b*.

Upon completion of the travel distance along the portion 20*b*, the secondary fluid is admitted into the upper annular chamber 5, wherefrom it is removed out of the heat exchanger through the fittings 7.

Obviously, even if the above description has been referred to a counterflow mode of operation of the primary and secondary fluids, nothing will change in principle if the heat exchanger is operated in the uniflow mode, as nothing changes in principle when the counterflow operation of the exchanger is carried out with the directions of the primary and secondary fluids reversed.

It will be appreciated from the foregoing that the invention achieves its objects, and in particular the fact is underlined that the structure provided by this invention affords a construction procedure which is simple and ensures ease of inspection of the weldments: after the tube plates 2 and 3 have been assembled to the shroud 4, and in the absence of the inner jacket 11 and duct 30 rigid therewith, those tubes 20 are first inserted from above through diaphragms such as 60 which happen to be closest to the shroud 4, with their bent terminating portion 20*b* arranged inwardly in order to facilitate their passage through the annular space portion included inside the plate 2, each such tubes being then rotated about its own axis to bring said portion 20*b* to the position shown in the drawings, which permits connection, by application of a slight deflection, to the holes 42 present in the plate 2; upon completion of the welding of said tubes as described, visual and X-ray inspection of the completed weldments is easily carried out.

The following or successive tubes are next mounted, sequentially from the shroud 4 towards the inside, such as to have at all times access to the weldments, and lastly the outlet duct 34 is mounted along with the jacket 11 and duct 30 rigid therewith.

It will be appreciated that the terminating bent portions 20*b* are suitably offset, for the various tubes, in a vertical direction, to allow application of the above assembling sequence.

Figure 10:
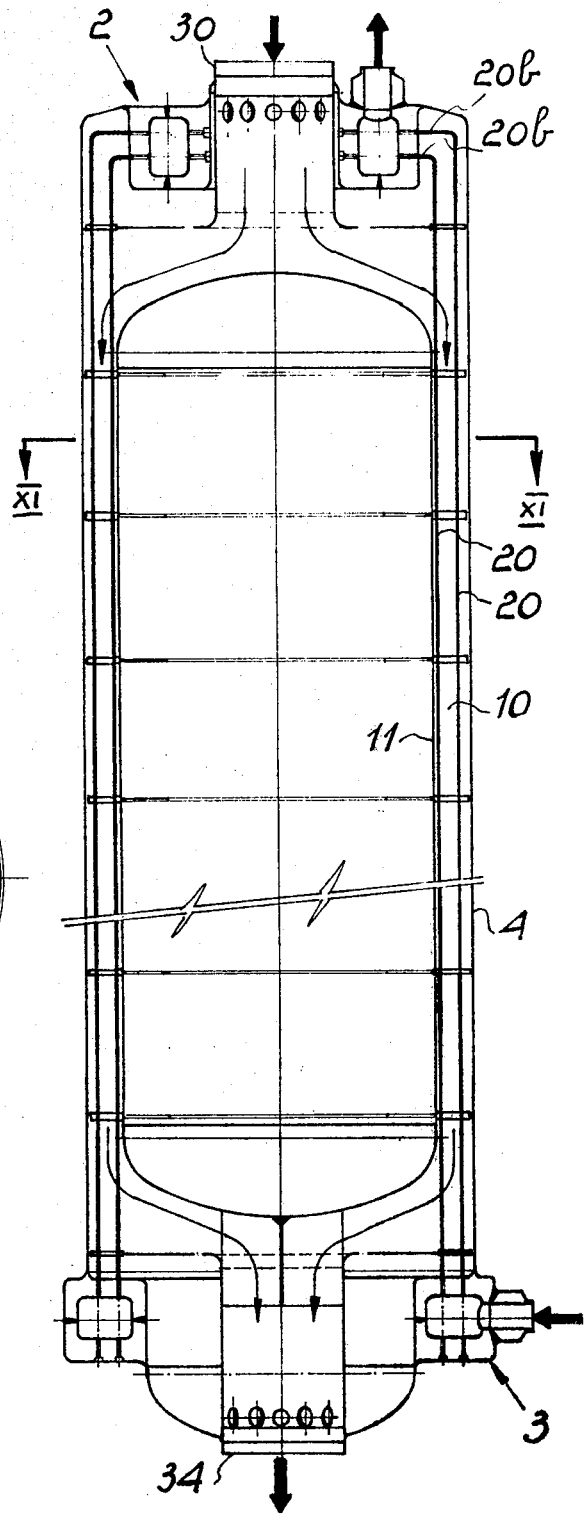
FIG. 10 shows schematically and in longitudinal section the heat exchanger according to a second embodiment of the invention.

FIG. 10 shows a second embodiment of this invention, wherein the bent termination portions 20*b* of the tubes 20 inserted through the interspace 10, included between the shroud 4 and inner jacket 11, are arranged towards the inside; in this solution, the upper plate 2 has the inlet duct 30 connected thereto by a procedure similar to those described with reference to the first embodiment for connecting the outlet duct 34 to the plate 3, while the outlet duct 34 is connected to the jacket 11 and inserted through the annular bore presented by the plate 3 by a procedure similar to those described in relation to the first embodiment with reference to the duct 30.

The assembling takes place by inserting the tubes 20 between the assembled plates 2 and 3 and in the presence of the jacket 11, prior to the installation of the shroud 4, obviously starting with those belonging to the innermost diameter.

Figure 12:
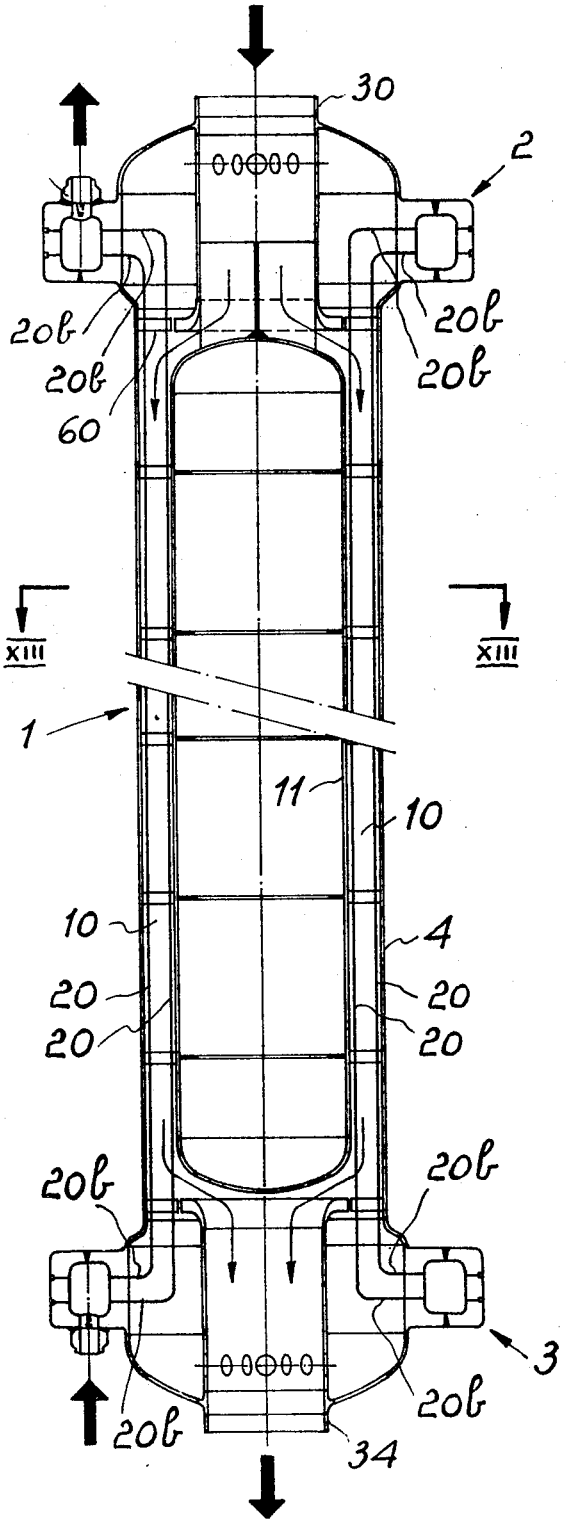
FIG. 12 shows schematically in longitudinal section the heat exchanger according to a third embodiment of the invention.
Figure 13:
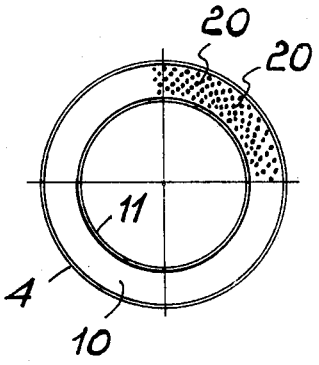
FIG. 13 is a schematical sectional view taken along the line XIII—XIII of FIG. 12.

FIG. 12 illustrates a third embodiment of this invention, wherein tubes 20 inserted through the interspace 10 included between the shroud 4 and inner jacket 11 have both their end or terminating portions **20*b* bent outwardly; in this solution, the inlet duct 30, wherewith the jacket 11 is rigid, and the outlet duct 34 are respectively connected to the tube plate 2 and tube plate 3 by a procedure similar to those described above with reference to the first embodiment for connection of the duct 30**.

Assembling is carried out as follows: after assembling the tube plates 2 and 3 to the shroud 4, and in the absence so far of the inner jacket 11 and duct 30 rigid therewith, those tubes are first brought close to the shroud 4 and inserted through the diaphragms such as 60, of composite construction, which lay closest to said shroud 4, thus bringing the ends of the bent portions **20*b* of the tubes to contact with the spigots 40** present on the tube plates; after welding said tubes in the manner described above, and without having to change the position of the heat exchanger, a visual and X-ray inspection of the completed weldments is conveniently effected.

The following tubes are then mounted sequentially from the shroud 4 inwardly, such as to have at all times the welding areas accessible, thereafter the outlet duct 34 and the jacket 11 with its duct 30 are mounted.

Figure 14:
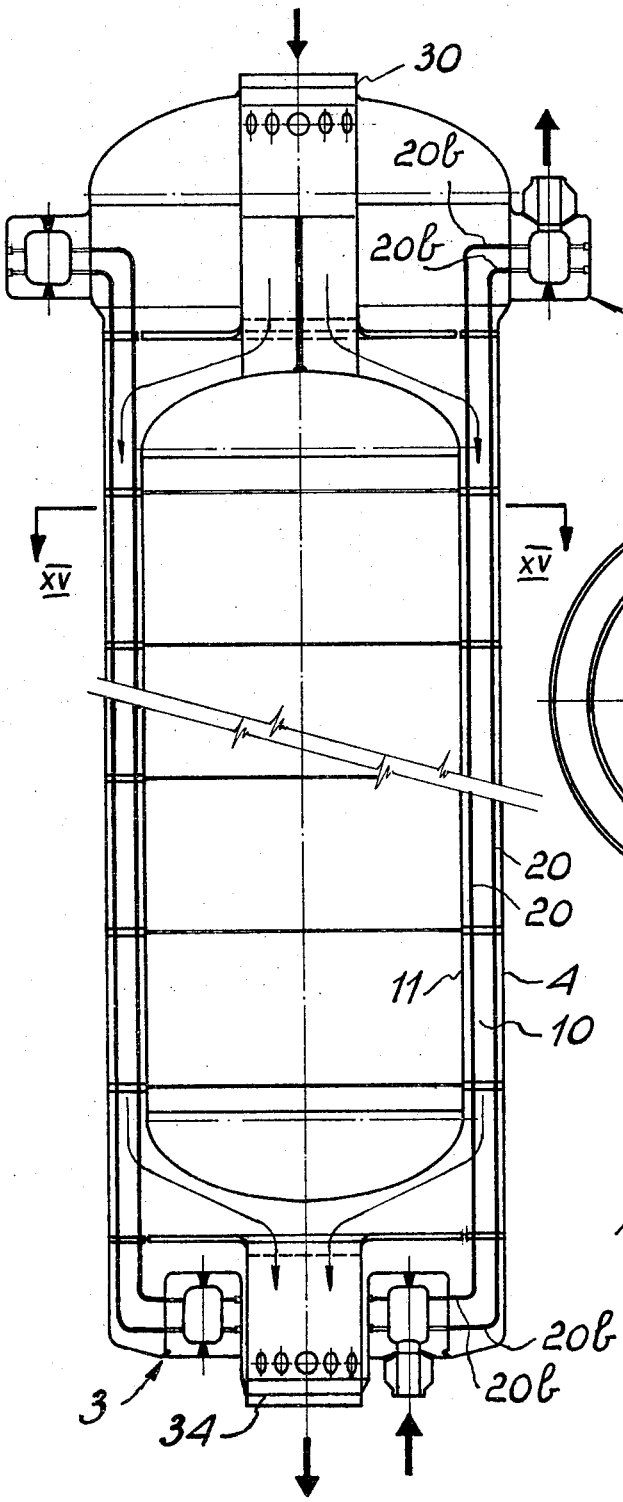
FIG. 14 shows schematically in longitudinal section the heat exchanger according to a fourth embodiment of the invention.
Figure 15:
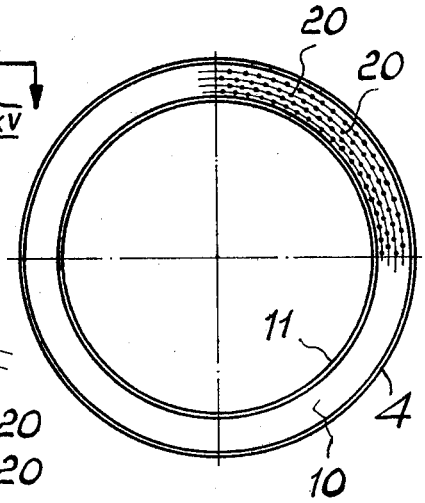
FIG. 15 is a schematical sectional view taken along the line XV—XV of FIG. 14.

In FIG. 14, there is illustrated a further variation of the invention, wherein the bent portions **20*b* of the tubes 20, being inserted through the interspace 10 included between the shroud 4 and inner jacket 11, are facing outwardly on the side of the tube plate 2, thereby they are connected to the inner cylindrical surface of the same, and facing inwardly on the side of the tube plate 3, thus inserting themselves in the outer cylindrical surface of said tube plate, which is accordingly smaller in diameter than the plate 2**.

The inlet duct 30 and outlet duct 34 are respectively connected to the tube plates 2 and 3 by a procedure similar to those adopted in the first embodiment described above with reference to the FIG. 1 of the drawings.

Assembling is carried out by procedures similar to those discussed in relation to the third embodiment of the invention hereinabove.

Figure 16:
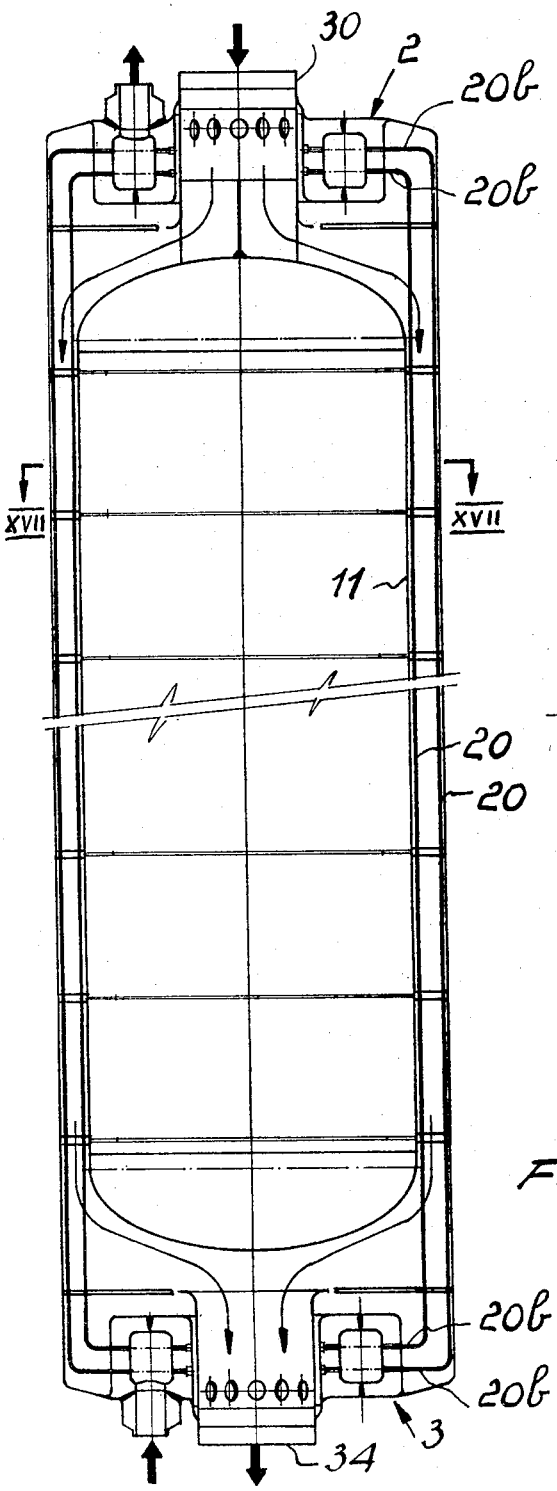
FIG. 16 shows schematically in longitudinal section the heat exchanger according to a fifth embodiment of the invention.

FIG. 16 shows a fifth embodiment or variation of this invention, wherein the portions **20*b* of the tubes 20 are facing inwardly both on the side of the tube plate 2 and on the side of the tube plate 3, which are accordingly substantially similar. The inlet duct 30 and outlet duct 34 are connected to the respective tube plates by a procedure which is similar to those described with reference to the first embodiment for connecting the duct 34**.

In the embodiment of FIG. 16, the inner jacket 11, with the duct 30 rigid therewith, and the duct 34 are assembled to the tube plates 2 and 3 prior to positioning the tubes of the tube nest in the composite diaphragms and to the welding thereof to the tube plates, the order for such operations being from the innermost tubes towards the outer ones, and the last operation to perform being the assembling of the outer shroud or casing.

The invention as described is susceptible to many modifications and variations, additionally to those described hereinabove, which are all intended to fall within the scope of this inventive concept. In particular, the upper tube plate could comprise, in the embodiment of FIG. 10, a forging defining a cylindrical space portion therein, instead of an annular one, in which case an ordinary header would be provided for introducing the primary fluid: the same would apply to the lower tube plate shown in FIG. 14, and to both tube plates in the case of FIG. 16.

Figure 18:
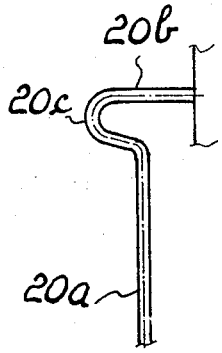
FIG. 18 illustrates a modification of the bent over terminal portion of the tubes in the tube nest.
Figure 17:
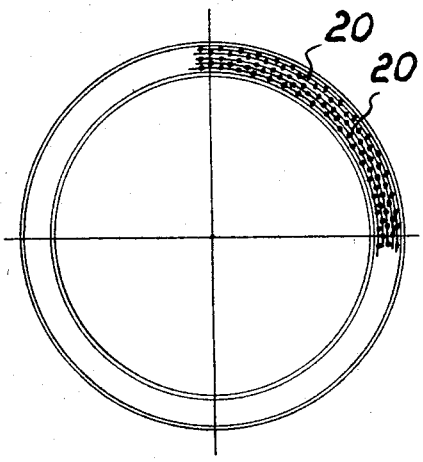
FIG. 17 is a schematical sectional view taken along the line XVII—XVII of FIG. 16.

Moreover, the terminating portion **20*b* which is substantially perpendicular to the axis of the exchanger tubes 20, may be connected to the rectilinear portion 20*a* of said tubes by means of a bend 20*c* of a type as shown in FIG. 18**.

It should be added to the foregoing, that nothing will change in principle if the heat exchanger is arranged upside down, i.e. in a 180° rotated position with respect to the one shown in the drawings, either reversing or not the direction of the fluid flows; obviously, in this upside down position, the plate 2, which was formerly the upper one, will be located at a lower level than the plate 3, which formerly was the lower plate. It should be further noted that the operation would remain the same as described hereinabove.

Furthermore, all of the details may be replaced by other technically equivalent elements.

In practicing the invention, the materials employed as well as the dimensions and shapes may be any ones, to suit individual requirements.

I claim:

1. A counterflow heat exchanger having two fixed tube plates, characterized in that it comprises an upper tube plate and a lower plate, said tube plates being coaxial with each other, between said upper and lower tube plates there extending a tube nest including a plurality of tubes laid parallel to the exchanger axis, said tubes of said plurality being connected to said tube plates and substantially distributed in a polar symmetry arrangement and having the terminating portion of at least one end substantially perpendicular to the exchanger axis, the rectilinear portion of said tube nest, substantially constituting the heat exchange zone, being enclosed with substantially uniform distribution within an annular interspace defined between an inner jacket and an outer shroud affixed to said tube plates.

2. A heat exchanger according to claim 1, characterized in that the terminating portions of the tubes in the tube nest are at one end only substantially perpendicular to the exchanger axis and arranged to face the exchanger outside.

3. A heat exchanger according to claim 2, characterized in that the free end of said terminating portion of said tubes is connected to a tube plate having a larger diameter of the bored inner cylindrical surface than the maximum bore intercenter diameter of the flat tube plate.

4. A heat exchanger according to claim 1, characterized in that the terminating portions of the tubes in the tube nest are only at one end substantially perpendicular to the exchanger axis and arranged to face the exchanger inside.

5. A heat exchanger according to claim 4, characterized in that the free end of said terminating portion of said tubes is connected to a tube plate having a smaller diameter of the bored outer cylindrical surface than the minimum bore intercenter diameter of the flat tube plate.

6. A heat exchanger according to claim 5, characterized in that the terminating portions of the tubes in the tube nest are at both ends substantially perpendicular to the exchanger axis and arranged to face the exchanger outside at both ends.

7. A heat exchanger according to claim 6, characterized in that the tube plates have a bored area, with uniformly distributed radial bores, at the inner cylindrical surface thereof and have substantially the same diameter.

8. A heat exchanger according to claim 1, characterized in that the terminating portions of the tubes in the tube nest are at both ends substantially perpendicular to the exchanger axis and arranged to face the outside of the exchanger with one end, and the inside of the exchanger with the other end.

9. A heat exchanger according to claim 8, characterized in that the tube plate whereto the outwardly bent ends of the tubes are connected has a bored area, with uniformly distributed radial bores, at the inner cylindrical surface, and has a larger diameter than the tube plate whereto the inwardly bent ends of the tubes are connected, said last-mentioned tube plate having another bored area at the outer cylindrical surface thereof.

10. A heat exchanger according to claim 1, characterized in that the terminating portions of the tubes in the tube nest are at both ends substantially perpendicular to the exchanger axis and arranged to face the inside of the exchanger at both ends.

11. A heat exchanger according to claim 10, characterized in that the tube plates have bored areas, with uniformly distributed radial bores, at the outer cylindrical surface thereof, and have substantially the same diameter.

12. A heat exchanger according to claim 1, characterized in that both ends of said tubes are connected to the respective tube plates by means of butt welded joints executed from the inside with an automatic process, the bore in the tube plate having a diameter substantially equal to the tube inside diameter and the joints being easy to inspect in the same order as the assembling sequence of the tubes from the area closest to the shroud towards the inside.

13. A heat exchanger according to claim 1, characterized in that the tube nest comprises tubes extending in a substantially rectilinear manner and being bent over at least at one end over a short length—not much longer than the mere extension necessary for the curvature, substantially for the purpose of allowing the connection thereof to the tube plates by means of butt welded joints executed from the inside with an automatic process—in conformity with a configuration resulting from the combination of one or more bends and a straight portion effective to bring the axis of the tube back to a substantially radial direction with respect to the cylindrical surface of said tube plates.

14. A heat exchanger according to claim 1, characterized in that said upper and lower tube plates comprise each an annular body defining an annular chamber therewithin, within the space inside the ring there being defined the inlet end and respectively axial outlet end of the primary fluid flow, said annular body being provided with fittings for conveying the secondary fluid.

15. A heat exchanger according to claim 1, characterized in that the lower tube plate, whereto the straight ends of the tubes in the tube nest are connected has a bored area in the shape of an annulus having bores distributed in a substantially uniform manner, the layout being substantially polar.

16. A heat exchanger according to claim 1, characterized in that the upper tube plate, whereto the tube ends of the terminating portions laying substantially perpendicular to the axis of the tube nest in the heat exchanger are connected, has a bored area at one of the cylindrical surfaces, said surfaces being coaxial with the axis of the heat exchanger.

17. A heat exchanger according to claim 1, characterized in that one of the tube plates comprises an annular body defining an annular chamber therewithin, within the space inside the ring there being defined the inlet end and respectively axial outlet end of the primary fluid flow, said annular body being provided with fittings for conveying the secondary fluid.

18. A heat exchanger according to claim 1, characterized in that said inner jacket has a substantially cylindrical configuration extending coaxial with said outer shroud, said inner jacket being closed at the top and bottom by closure members and connected to the exchanger structure at one end only, thereby ensuring freedom of expansion therefor.

19. A heat exchanger according to claim 1, characterized in that it comprises an axial inlet or outlet duct for the primary fluid, said duct being connected to the inner jacket and inserted in the annular space portion defined by the larger diameter tube plate and provided with a connection bottom cap for connection to said tube plate as well as with suitable openings, thereby defining an annular zone wherein the primary fluid is substantially stagnant, the edge of said duct facing the inner jacket being curled up such as to define, in cooperation with the closure member of said jacket, a peripheral passageway for the uniform distribution of the primary fluid flow.

20. A heat exchanger according to claim 1, characterized in that it comprises an axial inlet or outlet duct for the primary fluid, said duct being connected to the smaller diameter tube plate, and provided with suitable openings, thereby defining in cooperation therewith an annular zone wherein the primary fluid is substantially stagnant, the edge of said duct facing the inner jacket being curled up such as to define, in cooperation with the closure member of said jacket, a peripheral passageway for the uniform distribution of the primary fluid flow.

21. A heat exchanger according to claim 1, characterized in that it comprises an axial inlet or outlet duct for the primary fluid, said duct being connected to the inner jacket and inserted in the annular space portion defined by one of said tube plates whereto said duct is also connected and provided with suitable openings, thereby defining an annular zone wherein the primary fluid is substantially stagnant, the edge of said duct facing the inner jacket being curled up such as to define, in cooperation with the closure member of said jacket, a peripheral passageway for the uniform distribution of the primary fluid flow.

22. A heat exchanger according to claim 1, characterized in that it comprises an axial inlet or outlet duct for the primary fluid, said duct being connected to one of the tube plates and provided with suitable openings, thereby defining in cooperation therewith an annular zone wherein the primary fluid is substantially stagnant, the edge of said duct facing the inner jacket being curled up such as to define, in cooperation with the closure member of said jacket, a peripheral passageway for the uniform distribution of the primary fluid flow.

23. A heat exchanger according to claim 1, characterized in that all of the outer shroud weldments, including the connection weldments to the tube plates, are rewelded in the reverse direction.

24. A heat exchanger according to claim 1, characterized in that on said upper tube plate and on said lower tube plate there are provided through holes aligned with holes adapted for allowing the secondary fluid therethrough, said through holes being removably sealed tightly by closure plugs.

25. A heat exchanger according to claim 1, including closure plugs comprising a seal adapted for sealing said through holes tight, said seal being acted upon by a threaded pin in engagement with a threaded portion of said through holes and connected to a locking or safety threaded pin, between said threaded pin and said locking or safety threaded pin there being interposed a lockwasher.

26. A heat exchanger according to claim 1, characterized in that the structure is such as to afford the same advantages even when the exchanger is operated, as a second choice, in the uniflow mode.

* * * * *